US012152457B2

(12) United States Patent
Abreu Dos Santos

(10) Patent No.: US 12,152,457 B2
(45) Date of Patent: Nov. 26, 2024

(54) ADAPTER FOR CONNECTING CONCENTRIC CHRISTMAS TREE WITH ECCENTRIC PRODUCTION BASE

(71) Applicant: AKER SOLUTIONS DO BRASIL LTDA, Sao Jose Dos Pinhais Parana (BR)

(72) Inventor: Alexandre Augusto Abreu Dos Santos, Curitiba Parana (BR)

(73) Assignee: AKER SOLUTIONS DO BRASIL LTDA, Sao Jose Dos Pinhais Parana (BR)

( * ) Notice: Subject to any disclaimer, the term of this patent is extended or adjusted under 35 U.S.C. 154(b) by 0 days.

(21) Appl. No.: 18/269,756

(22) PCT Filed: Dec. 28, 2021

(86) PCT No.: PCT/NO2021/050286
§ 371 (c)(1),
(2) Date: Jun. 27, 2023

(87) PCT Pub. No.: WO2022/146144
PCT Pub. Date: Jul. 7, 2022

(65) Prior Publication Data

US 2024/0060383 A1 Feb. 22, 2024

(30) Foreign Application Priority Data

Dec. 28, 2020 (BR) ..... 102020026776-0

(51) Int. Cl.
*E21B 33/043* (2006.01)
*E21B 33/038* (2006.01)

(52) U.S. Cl.
CPC ..... *E21B 33/043* (2013.01); *E21B 33/038* (2013.01)

(58) Field of Classification Search
CPC ..... E21B 33/038; E21B 33/043
See application file for complete search history.

(56) References Cited

U.S. PATENT DOCUMENTS 3,095,927 A 7/1963 Rhodes
4,089,377 A * 5/1978 Chateau ..... E21B 33/043 285/914

(Continued)

FOREIGN PATENT DOCUMENTS

BR 202015019725-5 U2 7/2016
CN 202441313 U 9/2012

(Continued)

*Primary Examiner* — Aaron L Lembo
(74) *Attorney, Agent, or Firm* — Norman B. Thot

(57) ABSTRACT

An adapter for connecting a wet Christmas tree to an eccentric adapter production base. The adapter includes a hydraulic connector, a guide bushing which comprises penetrators for actuation of a dual sealing valve, hydraulic and electric plates with command and monitoring functions of resident equipment, two slide AI valves which provide a testable barrier of an annulus, an ROV panel which commands hydraulic functions, a top interface which interacts with the wet Christmas tree, a bottom interface which interfaces and/or communicates with the eccentric adapter production base and with a tubing hanger, a flow line connector with an integrated flow line mandrel, and a locking system with a sealing lip arranged inside the bottom interface. The top interface has a top guide funnel-shaped structure. The bottom interface has a structure of a connector and the guide bushing comprising the penetrators. The locking system interfaces with the eccentric adapter production base.

1 Claim, 6 Drawing Sheets

(56) References Cited

U.S. PATENT DOCUMENTS

| | | | | |
|---|---|---|---|---|
| 4,749,046 | A * | 6/1988 | Gano | E21B 23/12 166/368 |
| 5,941,574 | A * | 8/1999 | Hamilton | E21B 33/038 285/35 |
| 6,227,300 | B1 | 5/2001 | Cunningham et al. | |
| 6,719,059 | B2 | 4/2004 | Dezen et al. | |
| 7,219,740 | B2 * | 5/2007 | Saucier | E21B 34/04 166/344 |
| 7,296,629 | B2 * | 11/2007 | Bartlett | E21B 47/024 166/344 |
| 7,422,066 | B2 | 9/2008 | Rodrigues et al. | |
| 8,662,184 | B2 * | 3/2014 | June | E21B 33/038 166/344 |
| 9,382,771 | B2 * | 7/2016 | Hart | E21B 33/043 |
| 9,784,063 | B2 * | 10/2017 | June | E21B 33/035 |
| 9,797,226 | B2 | 10/2017 | Yeh et al. | |
| 9,945,202 | B1 * | 4/2018 | June | E21B 33/038 |
| 11,118,418 | B2 * | 9/2021 | Rivlin | E21B 33/035 |
| 2007/0169940 | A1 | 7/2007 | Fenton et al. | |
| 2015/0247371 | A1 | 9/2015 | Kekarainen | |
| 2017/0183935 | A1 | 6/2017 | Brown et al. | |
| 2023/0130315 | A1 * | 4/2023 | Anderson | E21B 47/06 166/341 |

FOREIGN PATENT DOCUMENTS

| | | | |
|---|---|---|---|
| EP | 1 021 637 | A1 | 7/2000 |
| GB | 2 397 312 | A | 7/2004 |
| NO | 20140270 | A1 | 9/2015 |

* cited by examiner

ADAPTER FOR CONNECTING CONCENTRIC CHRISTMAS TREE WITH ECCENTRIC PRODUCTION BASE

CROSS REFERENCE TO PRIOR APPLICATIONS

This application is a U.S. National Phase application under 35 U.S.C. § 371 of International Application No. PCT/NO2021/050286, filed on Dec. 28, 2021 and which claims benefit to Brazilian Patent Application No. 102020026776-0, filed on Dec. 28, 2020. The International Application was published in English on Jul. 7, 2022 as WO 2022/146144 A1 under PCT Article 21(2).

FIELD

The present invention pertains to the field of equipment for oil exploration. The present invention more specifically relates to a new adapter for use in subsea wells that enables wet concentric Christmas trees to connect with eccentric adapter production bases.

BACKGROUND

The subsea equipment of the wet Christmas tree (WCT) type are designed for a determined useful life, their integrity being limited by the thickness of walls which are made of forged metal parts, generally in pipes of lower thickness, by wear and tear and by corrosion, being governed by applicable codes that limit the safety factor to its components. After reaching a certain age or wear, there is a need to decommission (i.e., withdraw) the WCT set which generates high costs that are often not duly foreseen in addition to the loss of oil or gas production. Once it is deemed that the well may still be viable, the removal of the production column to change the WCT entails high additional costs and risks that tend to thwart the feasibility of maintaining production in that these costs may not offset the low productivity that is typical of wells referred to as mature, which are near the end of their useful life and therefore have lower productivity.

If a well is still viable, maintenance is justified of part of the equipment installed, such as the production column and the adapter production base (APB), when present, where the production tubing hanger (TH) is anchored. This utilization provides major savings and lower risk in operations, decreasing the investment to reactivate the well. However, older THs use a system of annulus fluid retention via a non-testable dual sealing valve (DSV), which is activated by the tip of the annulus line, a condition that may not be accepted under the codes in force since, upon withdrawing the tip, there is no guarantee of closing the valve, thereby triggering a risk that sea water will enter into the well which is an unacceptable condition under applicable codes.

The problem consists of the difference in standards of interfaces among standardized equipment, initially using models with two eccentric lines with 4.1/16 in for the production of oil and gas and 2.1/16 in for injection of fluids to the well, whereas the most up-to-date equipment uses a concentric production line of 5.1/8 in and eccentric injection line of 2.1/16 in making a mutually compatible interface impossible.

The equipment proposed by the present invention not only enables the coupling of different interfaces, acting as an adapter, but also allows the production column to be maintained, whereby the components with a compromised integrity or which do not conform with applicable codes are substituted and that the DSV, whose function is not supported by the codes, be replaced with at least two testable barriers with a metal sealing, as required by the same applicable codes, all encompassed within the same equipment that accumulates the function of adaptation.

The device additionally also allows the preservation of the lines of the production column that make the outflow of oil and gas and injection in the well in that it permits the maintenance of the APB.

The present invention prevents the withdrawal of the production column coupled to the TH, provides an alternative for substituting the annular blockage safely and testably prior to uncoupling the WCT, and permits the use of more current WCT models, thereby delaying well decommissioning, all at a lower cost when compared with the solutions currently in effect which involve the complete substitution of the WCT set and the associated production column.

NO 20140270 A1 describes a system to perform subsea well review operations comprising a single-bore emergency cut package located on a lower riser package that can be connected to a valve tree to be closed off, the system having a main bore extending through the system from a riser coupled to the mono-bore emergency disconnection package.

US 2017/183935 A1 describes an adapter for a Christmas tree in the field of oil or gas comprising a first interface to connect the adapter to a corresponding Christmas tree interface on top of the Christmas tree, a second interface, at least a feed passage, and at least one of a well barrier element, an internal profile for defining a plug, a hanger or a hanger and plug combined.

US 2015/247371 A1 describes a subsea Christmas tree set having a main bore and a ring bore, wherein the main bore aligns with the main bore of the pipes hanger and the ring bore of the Christmas tree communicates with the bore of the pipe hook annulus when the Christmas tree set is installed above a pipes hanger of a subsea well.

EP 1021637 A1 describes a slimbore marine riser and a BOP for a subsea completion system which includes a tubing spool secured to the wellhead at the sea floor, whereby the tubing spool has an internal landing profile for a tubing hanger with a reduced diameter, which is arranged and dimensioned to pass through the bore of the riser and the BOP at the end of a landing string, thereby providing a passage through the tubing spool which provides communication from a point above the tubing hanger to the well annulus below the hanger.

U.S. Pat. No. 9,797,226 B1 describes a wellbore apparatus and method comprising a first wellbore tool having a primary flow path and at least a secondary flow path, and a second wellbore tool having a primary flow path and a secondary flow path, wherein the radial center of the primary flow path in the first wellbore tool is offset from a radial center of the primary flow path in the second wellbore tool. The wellbore comprises a crossover joint connecting the first wellbore tool to the second wellbore tool having a primary flow path fluidly connecting the primary flow path of the first well tool to the primary flow path of the second well tool and at least one secondary flow path fluidly connecting the at least one secondary flow path of the first well tool to the at least one secondary flow path of the second wellbore tool.

BR 202015019725-5 U2 describes a simple integral wellhead and other components for application in oil and gas producing wells with natural elevation and artificial elevation and fluid injection wells, all with the subsurface installations with a column of tubes and components, with characteristics similar to the production head and conventional simple Christmas tree, which, when installed, eliminates the disconnection of the production line during the interventions.

CN 202441313 U describes a single-tube double-well sea thermal well port device which is applicable to the thickened oil thermal production process of an offshore single-tube double-well platform, where the glove head, a pipe head, and a Christmas tree are divided structures in the form of a fan, where a pipe head is connected to the lower flange and flange sleeve of the head, where the structures form eccentric and concentric arrangements.

SUMMARY

The prior art has to date not described a device which is designed to enable the association of wet concentric Christmas trees with eccentric adapter production bases or which provides a solution that enables the exploitation of the production column with its tubing hanger, and that substitutes a dual barrier valve with metal sealing and testable which solves the problem of non-compliance with applicable codes.

In an embodiment, the present invention provides an adapter for connecting a concentric wet Christmas tree to an eccentric adapter production base (APB). The adapter includes a hydraulic connector, a guide bushing which comprises penetrators for actuation of a dual sealing valve (DSV), hydraulic plates and electric plates each comprising command and monitoring functions of resident equipment, two slide AI valves which are each configured to provide a testable barrier of an annulus, an ROV panel which is configured to command hydraulic functions, a top interface which is configured to interact with the concentric wet Christmas tree (WCT), a bottom interface which is configured to at least one of interface with and communicate with the eccentric adapter production base (APB) and with a tubing hanger (TH), a flow line connector (FLC) comprising an integrated flow line mandrel (FLM), and a locking system comprising a sealing lip which is arranged inside the bottom interface. The top interface has a structure which is shaped with a top guide funnel. The bottom interface has a structure of a connector and the guide bushing comprising the penetrators. The locking system is configured to interface with the eccentric adapter production base (APB).

DETAILED DESCRIPTION

Figure 1:
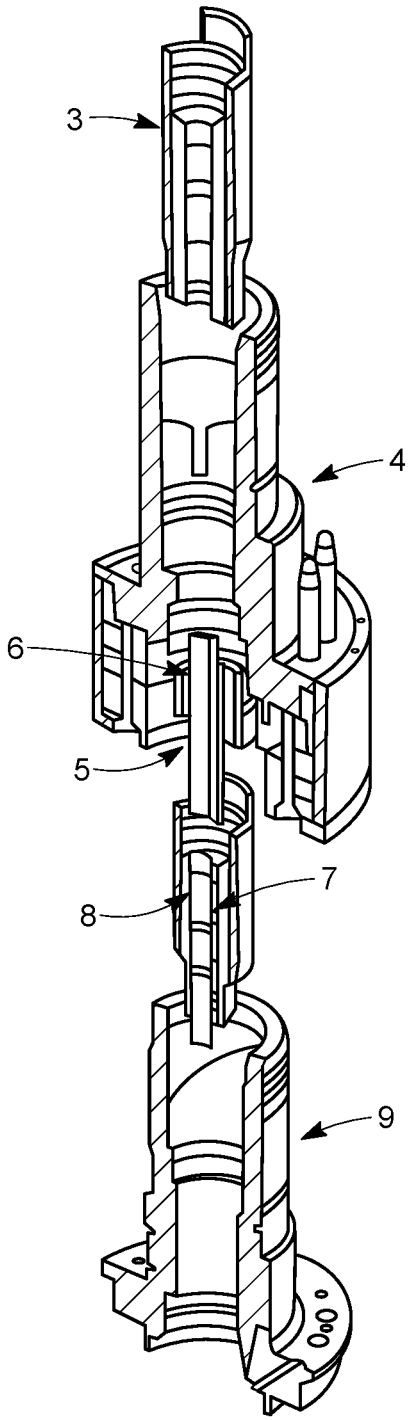
FIG. 1 shows a cross-sectional and blown-up view of the central arrangement of the adapter of the APB (9) represented with its mandrel, where it is possible to see the body (4), the false tubing hanger (3), the guide bushing of the connection (6) of the non-concentric production line to the concentric line with the penetrators (5), the DSV (7) and the resident tubing hanger (TH) with non-concentric boring (8)

The present invention consists of equipment used in oil exploration that enables a continued use of an old subsea production system, normally endowed with interfaces considered obsolete or non-standard, thereby preserving part of the equipment by replacing only those elements whose integrity might typically be compromised, preserving the production column and the connected flow lines.

In one embodiment, there is provided an adapter (1) that permits the installation of concentric wet Christmas trees—WCT (2) and greater production passages in adapter production bases—APB (9), associating a resident tubing hanger (8) with an eccentric profile and of smaller passage, without the need for removing the production column.

The device of the present invention may accordingly provide for longer life of the equipment whose integrity is compromised, thereby enabling the substitution of part of the system in use preserving the APB (9) with the production column, preventing the high costs related to the recovery and/or eventual substitution thereof. It may additionally enable the preservation of the flow lines previously installed in the APB (9).

The use thereof may further replace the function of the dual sealing valve—DSV (7) in the annulus of the resident tubing hanger—TH (8) with one or more slide AI valves (25) testable after installation in accordance with the standard currently provided in the WCT (2) used.

Installed on the APB (9), the adapter (1) is endowed with an eccentric connector capable of aligning the production passages, thereby enabling the concentric WCT (2) to land on the eccentric APB (9) regardless of the manufacturer's model.

The adapter (1) is further provided with penetrators (5), with one penetrator specifically on the annulus line (22) which opens the DSV (7), thereby allowing the passage of the line permanently after installation. On the body (4) of the adapter (1), which performs the function of an interface for the concentric WCT (2), there are additionally provided two slide AI valves (25), which are also known as "annulus intervention" (AI), that enable the blockage of the flow and the sealing test of the annulus, thereby providing the feasibility of future barrier tests prior to operations with the WCT (2) and allowing for the safe withdrawal thereof by preventing sea water from entering into the well which is an undesirable condition for obvious reasons.

The adapter (1) described herein may enable the substitution of the most critical parts, such as the WCT (2), preserving the most expensive part of the system and operations, which is the removal and substitution of the production column, maintaining the APB (9), the TH (8), and even the flow lines, thereby optimizing the cost for updating the systems with compromised integrity and complying with legislation in force.

In other words, the adapter of the present invention may allow the installation of the WCT (2) having different standards (pre-salt or post-salt) and classes of pressure (5 ksi and 10 ksi). It may also allow the WCT (2) to be altered to receive hub-type connections enabling the connection by vertical connection modules (VCM) or horizontal (HCS) for interfaces with the production, injection and/or umbilical lines.

These properties confer to the adapter (1) the property of allowing the withdrawal of just part of the WCT (2) set, maintaining the original production column, even if the obsolete dual sealing valves DSV (7) are installed, transforming the original system with an eccentric WCT (2) into a concentric one, and replacing the DSV (7) with slide AI valves (25).

In this adjustment, there are other relevant points to enable the exchange between the parts, such as the hydraulic logics using auxiliary hydraulic plates (15) (stab plates) which provide the hydraulic interface that was previously exclusive to the flow line mandrel FLM (10) and its connector (16), enabling that, jointly with a false tubing hanger (3) or "dummy tubing hanger", installed within the adapter (1), and with a false mandrel of the flow lines, herein denominated flow line connector adapter—FLCA (11), can provide the maintenance of the original hydraulic logics of both equipment of different standards.

Figure 3:
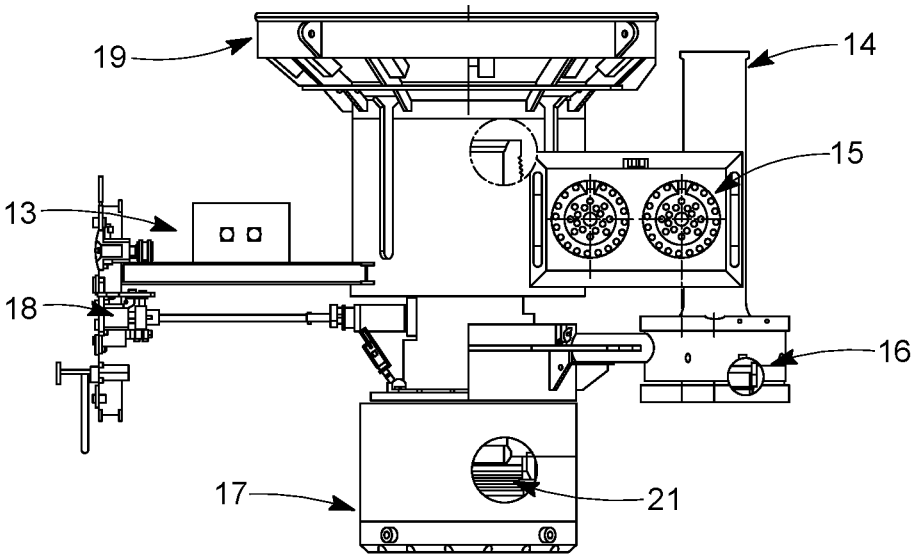
FIG. 3 shows an adapter according to an example of the present invention in a rear view, where it is possible to see the hydraulic (15) and electric (13) interface plates, the ROV panel (18), the top integrated flow line mandrel—FLM (14), the flow line connector—FLC (16), the top interface (19) to WCT, the bottom interface (17) to APB and TH, and the locking system of the hydraulic connector (21)
Figure 4:
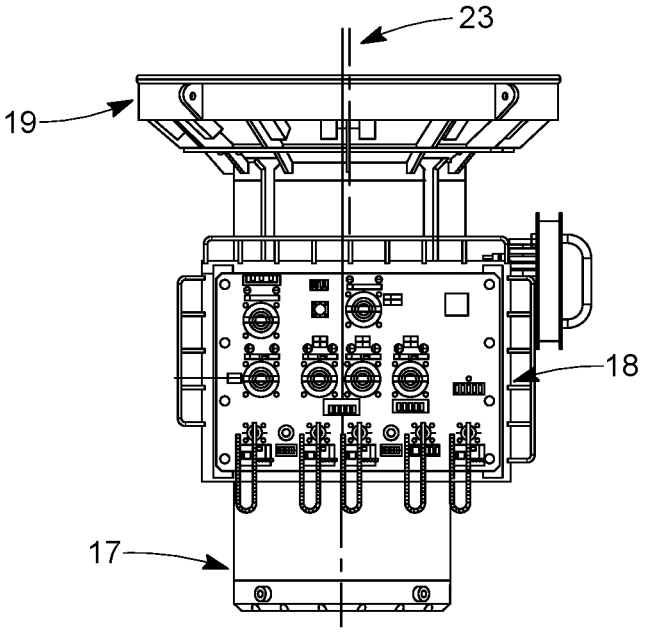
FIG. 4 shows an adapter according to an example of the present invention in a rear view, where it is possible to see the ROV panel (18), the top interface (19) to WCT, the bottom interface (17) to APB, and the eccentricity (23) between the top and bottom interfaces.

The adapter (1) of this example, as illustrated in FIGS. 3 and 4, is comprised of:

a) a hydraulic connector (21);
b) a guide bushing (6) with penetrators (5) for actuation of the DSV (7);
c) hydraulic (15) and electric (13) interface plates having command and monitoring functions of the resident equipment;
d) two slide AI valves (25) for testable barrier of the annulus;
e) an ROV panel (18) to command the hydraulic functions;
f) a top interface (19) for interaction with the WCT (2), which is shaped like a structure with a top guide funnel;
g) a bottom interface (17) for APB (9) and TH (8), which is configured like a connector and guide bushing (6) with penetrators (5);
h) a flow line connector—FLC (16) with an integrated flow line mandrel—FLM (14); and
i) a locking system with sealing lip inside the bottom interface (17) for interfacing with the APB (9).

The adapter (1) is normally associated to a false tubing hanger (3), if there is already a TH (8) in the APB (9), and to a hydraulic or electric connector by way of penetrators (5) for the false tubing hanger (3) with the already-resident tubing hanger (8). In the place of the false tubing hanger (3), it may optionally receive a new concentric tubing hanger (20) which is compatible with the WCT (2) to be installed, thereby preserving the already installed flow lines.

Figure 2:
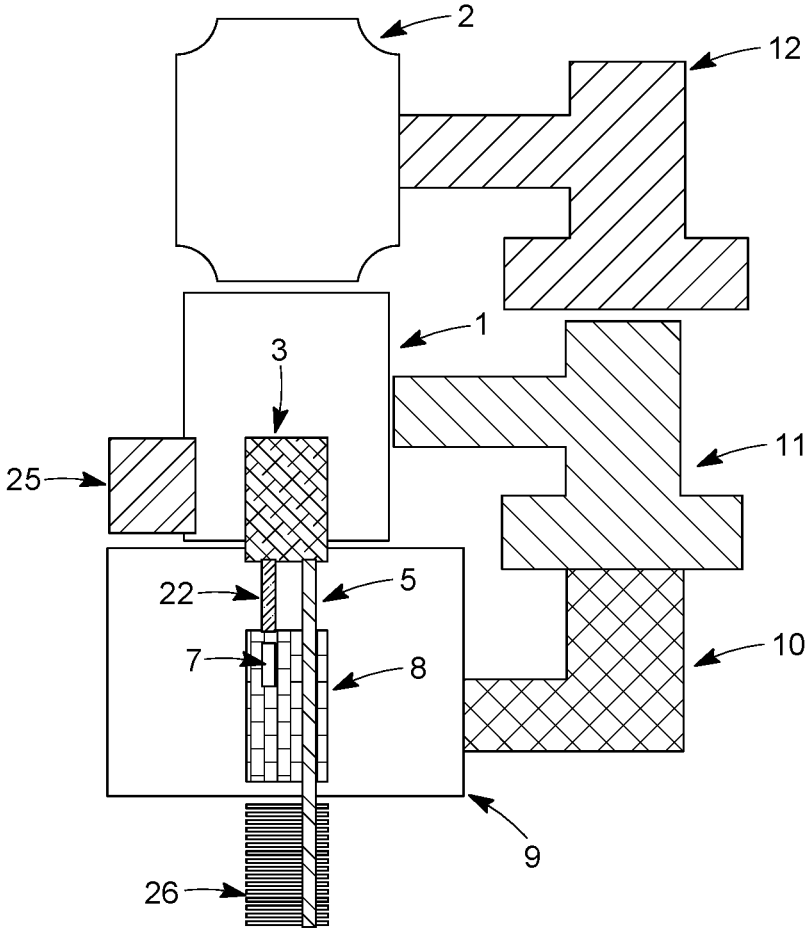
FIG. 2 schematically shows the arrangement of the system with the adapter (1) of the present invention, where it is possible to see the WCT (2), the APB (9), the connection with the resident tubing hanger (8), the penetrators (5), the false tubing hanger (3), the DSV (7), the slide AI valves (25), the flow line mandrel—FLM (10), the adapter flow line connector—AFLC (11), the main flow line connector—MFLC (12) and the wellhead (26)

In an arrangement for using the adapter (1) of the present invention, as illustrated in FIG. 2, the adapter (1) can, for example, be allocated between the WCT (2) and the APB (9), and the central part of the adapter (1) can, for example, be connected with the non-concentric resident tubing hanger (8) 4"×2" via a guide bushing (6) of the penetrators (5) that provides an interface to a false tubing hanger (3) with concentric top 5"×1" anchored on the adapter (1), thereby enabling the interface with an equally concentric WCT (2). The guide bushing (6) is provided with a set of penetrators (5), one penetrator being dedicated to the annulus line (22) with the function of activating the DSV (7) keeping it permanently open, and its function being testably replaced with two AI valves (25). On the side interface, the FLM (10) of the APB (9) provides an interface with the MFLC (12) situated on the WCT (2) via the AFLC (11), thereby providing the continuity of all the lines of the FLM (10) of the APB (3) up to the MFLC (12) on the WCT (2), following the hydraulic logics, and serving all the interfaces in effect in the WCT (2) to be installed.

The adapter (1) of the present invention is further endowed with a ROV panel (18) that enables the actioning of the interfaces and hydraulic valves. The top interface (19) provides the connection with the WCT (2), whereas the bottom interface (17) communicates with the APB (9) and with the resident TH (8).

Figure 5:
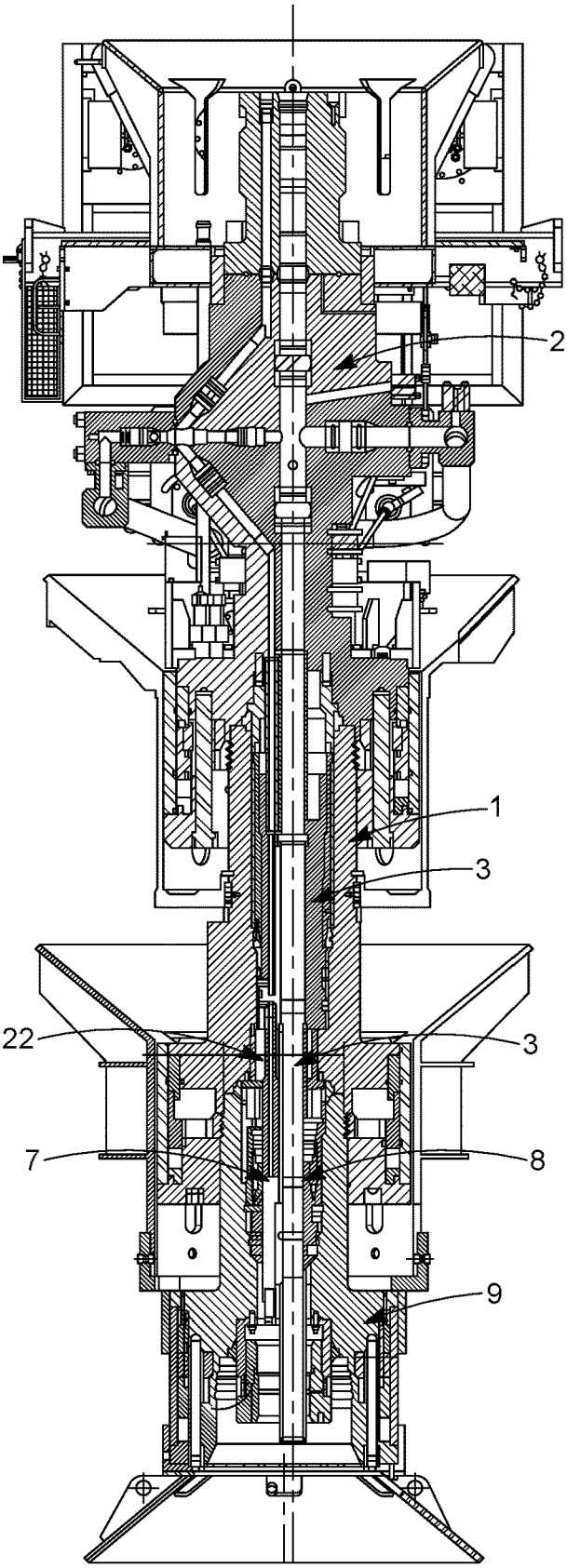
FIG. 5 shows a cross-sectional view of an arrangement according to an example of the resent invention in a configuration with complete (stack-up) set, where it is possible to see the WCT (2), the adapter (1), the APB (9) with TH (8), the penetrator of the annulus line (22) which is a sub item of the penetrators (5), the DSV (7), and the false tubing hanger (3)
Figure 6:
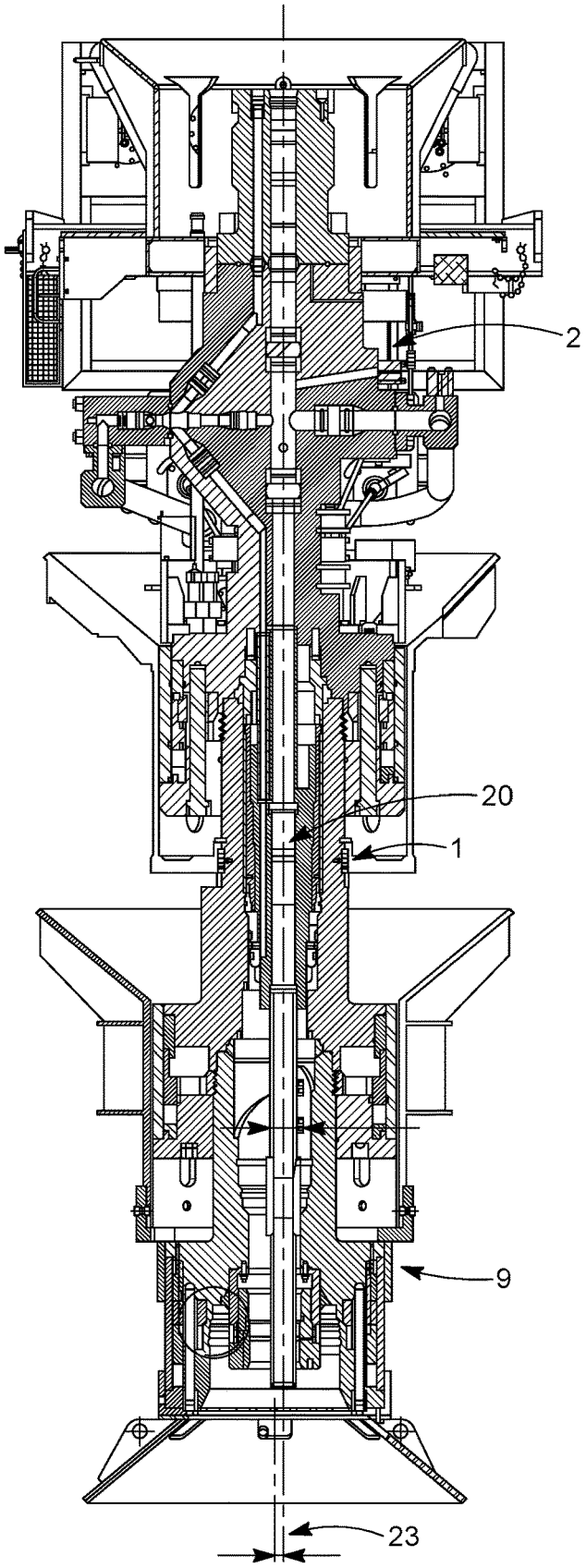
FIG. 6 shows a cross-sectional view of an example device in an alternative configuration applicable to an APB (9) without TH, where it is possible to see the new concentric tubing hanger (20), the WCT (2), the adapter (1), and eccentricity (23)

In this construction, prominence is given to the eccentricity (23) between the top interface (19) and the APB (9) with the resident tubing hanger (8) of different profiles, line gauge and standardizations, as illustrated in FIGS. 4 to 6.

In the configuration of a complete set or "stack-up", the penetrator of the annulus line (22) keeps the DSV (7) permanently open, as seen in FIG. 5, so that the slide AI valves (25), which are shown in the arrangement of FIG. 2, thereafter redundantly and testably execute the function of blockage.

In an alternative configuration for using the adapter (1) in an APB (9) without TH (8), as illustrated in FIG. 6, the original concentric tubing hanger (20) of the WCT (2) to be installed can be anchored to the mandrel of the adapter (1), thereby making it feasible to install a concentric WCT (2). This configuration enables the APB (9) to be maintained, along with the flow lines connected thereto, thereby enabling gain and preventing a de-installation of the lines, which is an operation involving considerable cost and risk.

Figure 7:
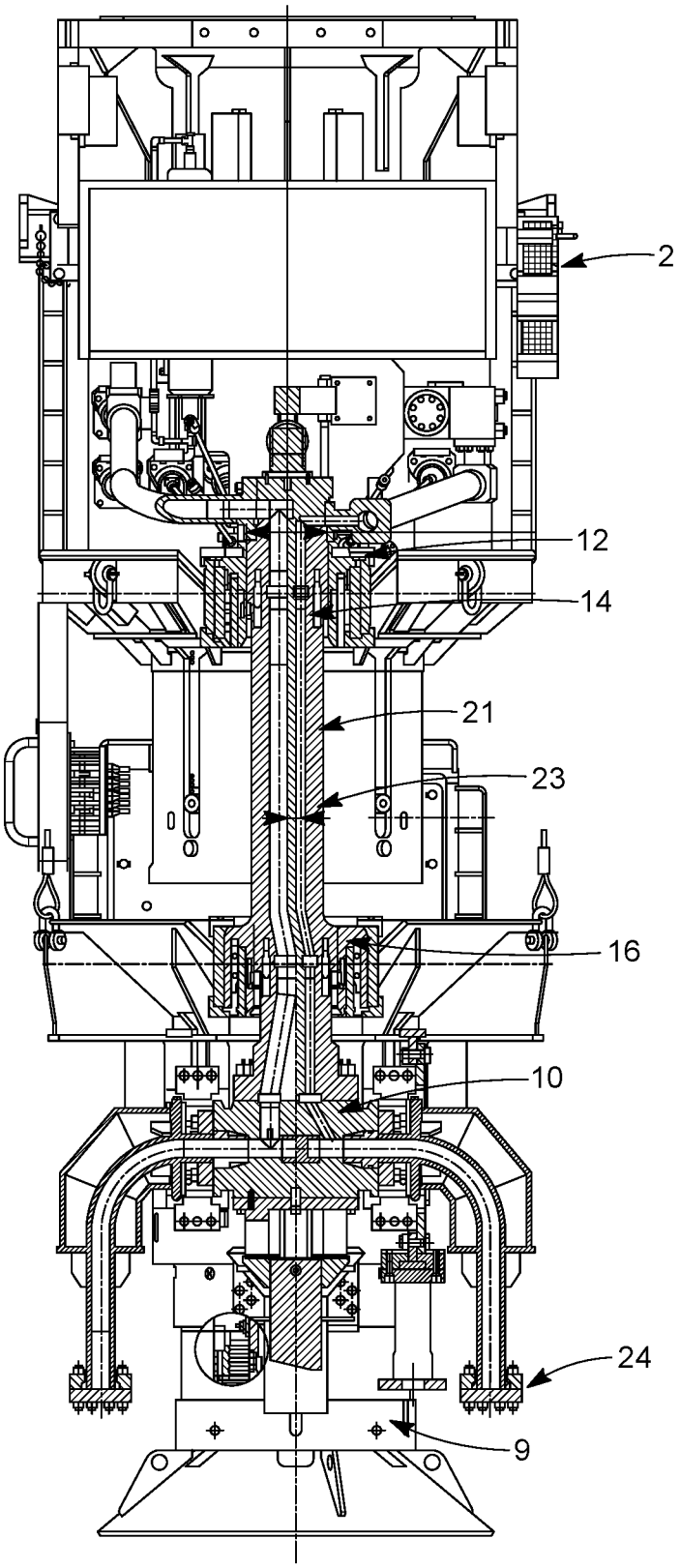
FIG. 7 shows a sectional side view of a device in an arrangement focusing on the interface of the FLM (10) of the APB (9) with the MFLC (12) of the WCT (2) and with the AFLC (11), where it is possible to see the eccentricity (23), and the inputs and outputs for the flow lines (24).

FIG. 7 shows a cross-sectional view of the adapter (1) where it is possible to see the interface of the FLM (10) of the APB (9) with the MFLC (12) of the WCT (2), which also has eccentricity due to the displacement of the WCT (2) since the mandrel of the adapter (1) is misaligned relative to its connector. The misalignment is offset on the interface (11), CLF set of the adapter, via its flow line connector (16) and the FLM (14), thereby enabling the interfaces of production, annulus and all other hydraulic and electric interfaces, and the latter when present. The flow lines (24) that provide an interface with the flanges remain connected.

The present invention is not limited to the representations mentioned or illustrated herein and should be understood within its broad scope. Many changes and other representations of the disclosure will come to mind for those skilled in the art to which this disclosure pertains, having the benefit of the teaching presented in the prior descriptions and accompanying drawings. It should additionally be understood that the present invention is not limited to the specific form disclosed, and that the changes and other forms are deemed to be comprised within the scope of the accompanying claims. Although specific terms are used herein, they are used only generically and descriptively and not with a limitative purpose.

LIST OF REFERENCE NUMERALS

1 Adapter
2 Wet Christmas tree (WCT)
3 False tubing hanger
4 Body
5 Penetrator
6 Guide bushing
7 Dual sealing valve (DSV)
8 Resident tubing hanger (TH)
9 Adapter production base (APB)
10 Flow line mandrel (FLM)
11 Adapter flow line connector (AFLC)
12 Main flow line connector (MFLC)
13 Electric interface plate
14 Top integrated flow line mandrel (FLM)
15 Hydraulic interface plate
16 Flow line connector (FLC)
17 Bottom interface
18 ROV panel
19 Top interface
20 Concentric tubing hanger
21 Hydraulic connector
22 Penetrator of the annulus line
23 Eccentricity
24 Flow line
25 Slide AI valve
26 Wellhead

What is claimed is:

1. An adapter for connecting a concentric wet Christmas tree to an eccentric adapter production base (APB), the adapter comprising:

a hydraulic connector;

a guide bushing which comprises penetrators for actuation of a dual sealing valve (DSV);

hydraulic plates and electric plates each comprising command and monitoring functions of resident equipment;

two slide AI valves which are each configured to provide a testable barrier of an annulus;

an ROV panel which is configured to command hydraulic functions;

a top interface which is configured to interact with the concentric wet Christmas tree (WCT), the top interface having a structure which is shaped with a top guide funnel;

a bottom interface which is configured to at least one of interface with and communicate with the eccentric adapter production base (APB) and with a tubing hanger (TH), the bottom interface having a structure of a connector and the guide bushing comprising the penetrators;

a flow line connector (FLC) comprising an integrated flow line mandrel (FLM); and a locking system comprising a sealing lip which is arranged inside the bottom interface, the locking system being configured to interface with the eccentric adapter production base (APB).

* * * * *